US010415806B1

(12) United States Patent
Hsu

(10) Patent No.: US 10,415,806 B1
(45) Date of Patent: Sep. 17, 2019

(54) HEMISPHERICAL ADJUSTING STRUCTURE

(71) Applicant: Dong Guan Jia Sheng Lighting Technology Co., Ltd. China, Dong-Guna, Guang-Dong (CN)

(72) Inventor: Kevin Hsu, Taichung (TW)

(73) Assignee: Dong Guan Jia Sheng Lighting Technology Co., Ltd. China, Guang-Dong (CN)

( * ) Notice: Subject to any disclaimer, the term of this patent is extended or adjusted under 35 U.S.C. 154(b) by 0 days.

(21) Appl. No.: 16/009,295

(22) Filed: Jun. 15, 2018

(51) Int. Cl.

| | |
|---|---|
| ***F21V 21/30*** | (2006.01) |
| ***F21V 21/14*** | (2006.01) |
| ***F21V 1/00*** | (2006.01) |
| ***F21V 23/00*** | (2015.01) |

(52) U.S. Cl.
CPC ..... *F21V 21/14* (2013.01); *F21V 1/00* (2013.01); *F21V 23/001* (2013.01)

(58) Field of Classification Search
None
See application file for complete search history.

(56) References Cited

U.S. PATENT DOCUMENTS

| | | | | |
|---|---|---|---|---|
| 9,523,493 | B2 * | 12/2016 | Chen | F21S 8/026 |
| 10,125,956 | B2 * | 11/2018 | Veloskey | F21V 17/02 |
| 10,215,374 | B2 * | 2/2019 | Xu | F21V 17/02 |

* cited by examiner

*Primary Examiner* — Vip Patel
(74) *Attorney, Agent, or Firm* — Alan D. Kamrath; Mayer & Williams PC

(57) ABSTRACT

A hemispherical adjusting structure includes a housing, an adjusting unit, a light source module and a driving device. The housing has a through hole. The light source module is mounted in the adjusting unit. The driving device drives the adjusting unit to move along a spherical direction of the housing. The adjusting unit includes an inner movable member and an outer movable member. The inner movable member is located inside of the housing and includes a receiving portion and an abutment. The outer movable member is located outside of the housing and includes a mounting stud and an extension. The mounting stud extends through the through hole and is inserted into the receiving portion. Thus, the adjusting unit is moved along the spherical direction of the housing so as to adjust the irradiating angles of the lamp.

7 Claims, 3 Drawing Sheets

HEMISPHERICAL ADJUSTING STRUCTURE

BACKGROUND OF THE INVENTION

1. Field of the Invention

The present invention relates to a lamp and, more particularly, to a hemispherical adjusting structure for a lamp.

2. Description of the Related Art

A lamp, such as a ceiling fitting, a recessed light, a downlight, a wall fitting, a ground light, a garden light or the like, emits rays outward to provide an illuminating function. The conventional lamp has an irradiating angle that is adjusted according to the practical requirement. Thus, the conventional lamp usually comprises an adjusting device to adjust the irradiating angle. The adjusting device includes a middle ring and two perpendicular shafts to perform the angle adjustment. However, the conventional adjusting device has a complicated structure and has a smaller adjusted angle.

BRIEF SUMMARY OF THE INVENTION

The primary objective of the present invention is to provide a hemispherical adjusting structure for adjusting an irradiating angle (or a lighting angle) of a lamp. Specifically, the hemispherical adjusting structure is used for adjusting the angle of infrared rays.

In accordance with the present invention, there is provided a hemispherical adjusting structure comprising a housing, an adjusting unit, a light source module and a driving device. The housing has a hemispherical shape and has a center provided with a through hole. The light source module is mounted in the adjusting unit. The driving device drives the adjusting unit to move along a spherical direction of the housing. The adjusting unit includes an inner movable member and an outer movable member detachably connected with the inner movable member. The inner movable member is located inside of the housing and includes a receiving portion and an abutment mounted on a periphery of the receiving portion. The abutment of the inner movable member has an outer face having a radian equal to that of an inner face of the housing. The outer movable member is located outside of the housing and includes a mounting stud and an extension mounted on a periphery of the mounting stud. The mounting stud of the outer movable member extends through the through hole of the housing and is inserted into the receiving portion of the inner movable member. The mounting stud of the outer movable member has an outer diameter smaller than an inner diameter of the through hole. The extension of the outer movable member has an inner face having a radian equal to that of an outer face of the housing.

Preferably, the housing is provided with at least one mounting portion located outside of the through hole. The at least one mounting portion is provided with a mounting hole.

Preferably, the inner movable member is provided with at least one locking groove, and the at least one mounting portion extends into the housing and is limited in at least one locking groove of the inner movable member.

Preferably, the housing is provided with a wire passage allowing passage of a conducting wire. The wire passage is formed in the at least one mounting portion.

Preferably, the receiving portion of the inner movable member is provided with a receiving recess which is provided with an internal thread, and the mounting stud of the outer movable member is received in the receiving recess of the receiving portion and is provided with an external thread screwed into the internal thread of the receiving recess.

Preferably, the light source module includes a circuit board mounted between the inner movable member and the outer movable member, a light emitting member mounted on the circuit board, and a lampshade mounted on the circuit board and located outside of the light emitting member.

Preferably, the mounting stud of the outer movable member has an interior provided with a fitting hole for receiving the light source module. The fitting hole has a bottom provided with a stepped limit portion. The lampshade of the light source module has a bottom provided with a restriction portion locked onto the stepped limit portion of the mounting stud.

According to the primary advantage of the present invention, the adjusting unit is moved along the spherical direction of the housing so as to adjust the irradiating angles of the lamp.

According to another advantage of the present invention, the mounting stud of the outer movable member is movable in the through hole of the housing to adjust the angles of the lamp according to the user's requirement.

According to a further advantage of the present invention, the hemispherical adjusting structure has a simplified construction and has a larger range of angle adjustment so as to increase the irradiating angle.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
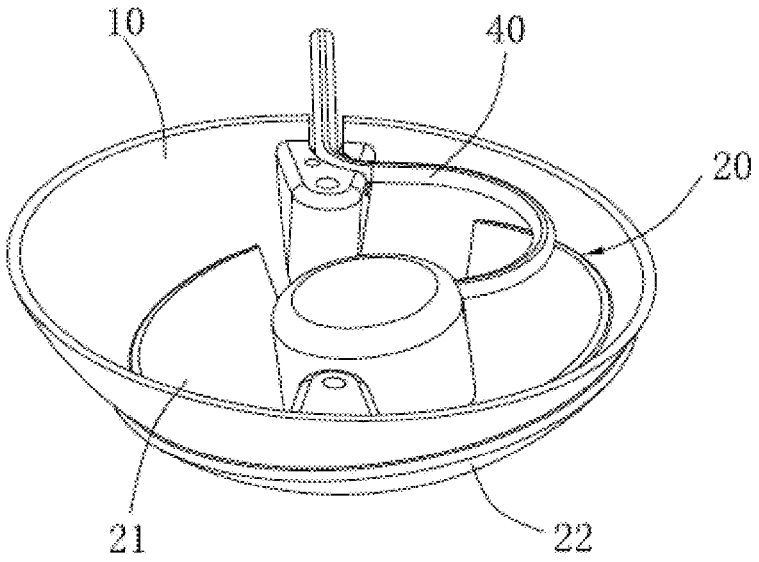
FIG. 1 is a perspective view of a hemispherical adjusting structure in accordance with the preferred embodiment of the present invention.
Figure 2:
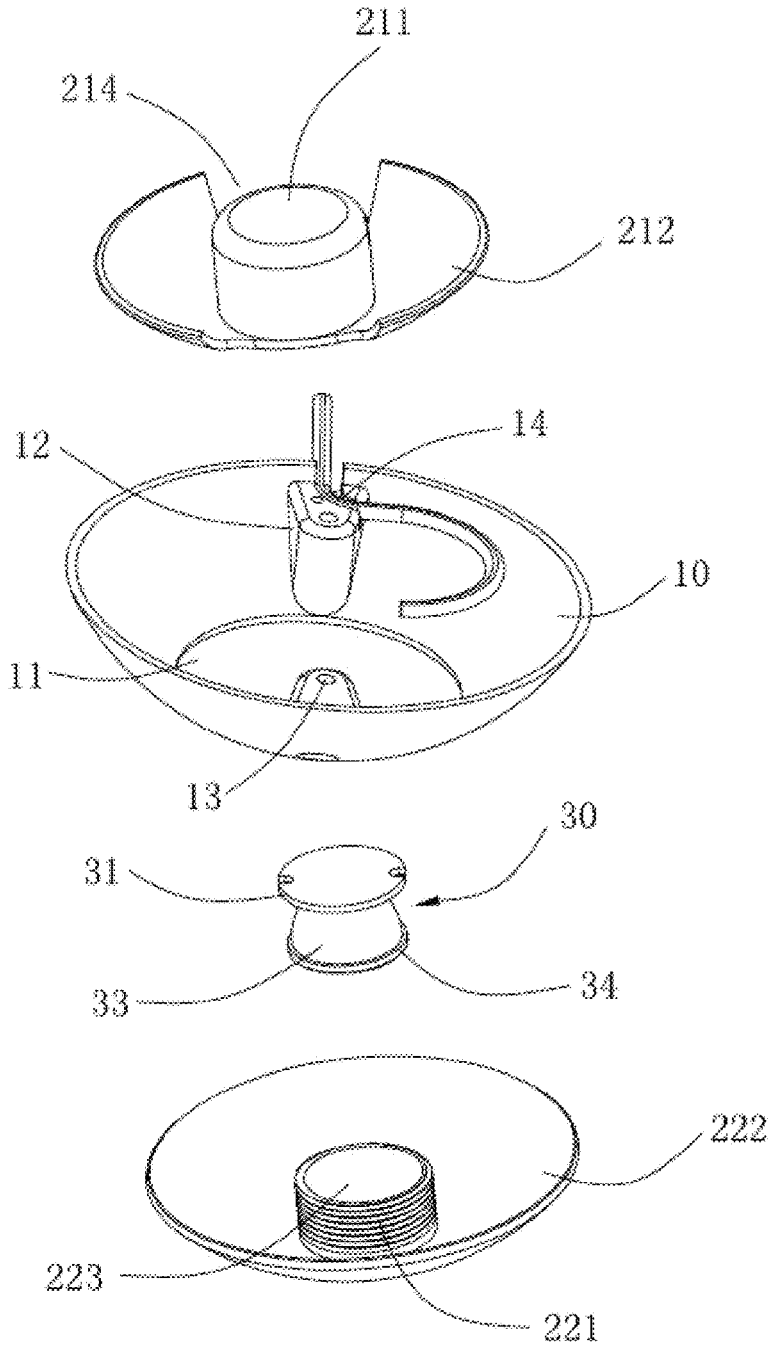
FIG. 2 is an exploded perspective view of the hemispherical adjusting structure in accordance with the preferred embodiment of the present invention.
Figure 3:
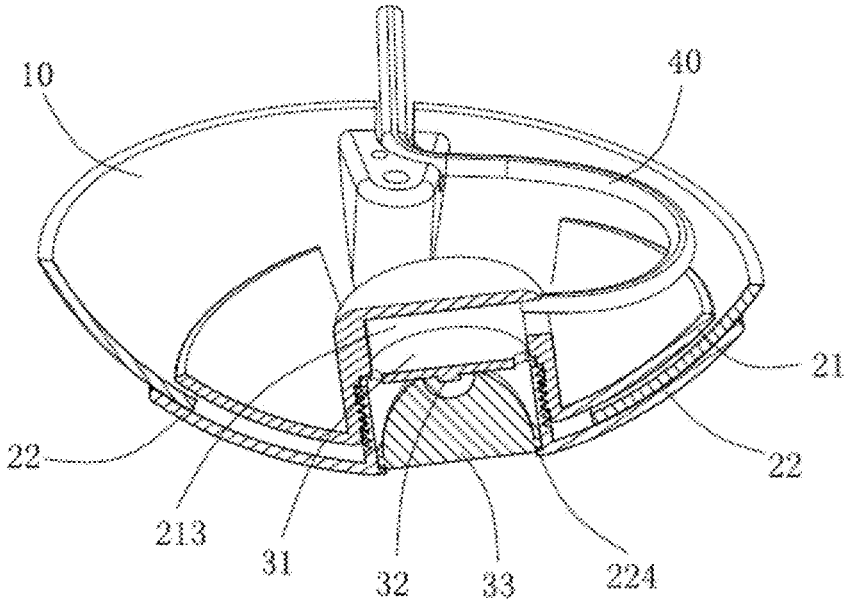
FIG. 3 is a perspective cross-sectional view of the hemispherical adjusting structure in accordance with the preferred embodiment of the present invention.

Referring to FIGS. 1-3, a hemispherical adjusting structure for a lamp in accordance with the preferred embodiment of the present invention comprises a housing 10, an adjusting unit 20, a light source module 30 and a driving device.

The housing 10 has a hemispherical shape and has a center provided with a through hole 11. The light source module 30 is mounted in the adjusting unit 20. The driving device drives the adjusting unit 20 to move along a spherical direction of the housing 10 so as to adjust various angles of the lamp. The adjusting unit 20 is mounted on rotatable and movable relative to the housing 10 to adjust the irradiating angle of the light source module 30. The adjusting unit 20 includes an inner movable member 21 and an outer movable member 22 detachably connected with the inner movable member 21.

The inner movable member 21 is located inside of the housing 10 and includes a hollow receiving portion 211 and an abutment 212 mounted on a periphery of the receiving portion 211. The abutment 212 of the inner movable member 21 has an outer face having a hemispherical shape with a radian equal to that of an inner face of the housing 10. The receiving portion 211 of the inner movable member 21 protrudes from an inner face of the abutment 212.

The outer movable member 22 is located outside of the housing 10 and includes a mounting stud 221 and an extension 222 mounted on a periphery of the mounting stud 221. The mounting stud 221 of the outer movable member 22 extends through the through hole 11 of the housing 10 and is inserted into the receiving portion 211 of the inner movable member 21. The mounting stud 221 of the outer movable member 22 has an outer diameter smaller than an inner diameter of the through hole 11, so that the mounting stud 221 of the outer movable member 22 is movable in the through hole 11 of the housing 10 to adjust the angles of the lamp. The extension 222 of the outer movable member 22 has an inner face having a hemispherical shape with a radian equal to that of an outer face of the housing 10.

In the preferred embodiment of the present invention, the housing 10 is provided with at least one mounting portion 12 located outside of the through hole 11. The at least one mounting portion 12 is provided with a mounting hole 13 which penetrates the at least one mounting portion 12 from top to bottom. Preferably, the housing 10 is provided with two mounting portions 12. The mounting hole 13 is used for mounting a screw to attach the housing 10 to a ceiling, a wall or a bracket.

In the preferred embodiment of the present invention, the inner movable member 21 is provided with at least one locking groove 214, and the at least one mounting portion 12 extends into the housing 10 and is limited in at least one locking groove 214 of the inner movable member 21. Preferably, the inner movable member 21 is provided with two locking grooves 214.

In the preferred embodiment of the present invention, the housing 10 is provided with a wire passage 14 allowing passage of a conducting wire 40. Preferably, the wire passage 14 is formed in the at least one mounting portion 12.

In the preferred embodiment of the present invention, the receiving portion 211 of the inner movable member 21 is provided with a receiving recess 213 which is provided with an internal thread, and the mounting stud 221 of the outer movable member 22 is received in the receiving recess 213 of the receiving portion 211 and is provided with an external thread screwed into the internal thread of the receiving recess 213.

In the preferred embodiment of the present invention, the light source module 30 includes a circuit board 31 mounted between the inner movable member 21 and the outer movable member 22, a light emitting member 32 mounted on a bottom of the circuit board 31, and a lampshade 33 mounted on the circuit board 31 and located outside of the light emitting member 32. Preferably, the light emitting member 32 is a light emitting diode (LED).

In the preferred embodiment of the present invention, the mounting stud 221 of the outer movable member 22 has an interior provided with a fitting hole 223 for receiving the light source module 30. The fitting hole 223 penetrates the mounting stud 221 from top to bottom and has a bottom provided with a stepped limit portion 224 protruding inward. The lampshade 33 of the light source module 30 has a top resting on the circuit board 31 and has a bottom provided with a restriction portion 34 protruding outward and locked onto the stepped limit portion 224 of the mounting stud 221.

Accordingly, the adjusting unit 20 is moved along the spherical direction of the housing 10 so as to adjust the irradiating angles of the lamp. In addition, the mounting stud 221 of the outer movable member 22 is movable in the through hole 11 of the housing 10 to adjust the angles of the lamp according to the user's requirement. Further, the hemispherical adjusting structure has a simplified construction and has a larger range of angle adjustment so as to increase the irradiating angle.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A hemispherical adjusting structure comprising:

a housing, an adjusting unit, a light source module and a driving device;

wherein:

the housing has a hemispherical shape and has a center provided with a through hole;

the light source module is mounted in the adjusting unit;

the driving device drives the adjusting unit to move along a spherical direction of the housing;

the adjusting unit includes an inner movable member and an outer movable member detachably connected with the inner movable member;

the inner movable member is located inside of the housing and includes a receiving portion and an abutment mounted on a periphery of the receiving portion;

the abutment of the inner movable member has an outer face having a radian equal to that of an inner face of the housing;

the outer movable member is located outside of the housing and includes a mounting stud and an extension mounted on a periphery of the mounting stud;

the mounting stud of the outer movable member extends through the through hole of the housing and is inserted into the receiving portion of the inner movable member;

the mounting stud of the outer movable member has an outer diameter smaller than an inner diameter of the through hole; and the extension of the outer movable member has an inner face having a radian equal to that of an outer face of the housing.

2. The hemispherical adjusting structure of claim 1, wherein the housing is provided with at least one mounting portion located outside of the through hole, and the at least one mounting portion is provided with a mounting hole.

3. The hemispherical adjusting structure of claim 2, wherein the inner movable member is provided with at least one locking groove, and the at least one mounting portion extends into the housing and is limited in at least one locking groove of the inner movable member.

4. The hemispherical adjusting structure of claim 2, wherein the housing is provided with a wire passage allowing passage of a conducting wire, and the wire passage is formed in the at least one mounting portion.

5. The hemispherical adjusting structure of claim 1, wherein the receiving portion of the inner movable member is provided with a receiving recess which is provided with an internal thread, and the mounting stud of the outer movable member is received in the receiving recess of the receiving portion and is provided with an external thread screwed into the internal thread of the receiving recess.

6. The hemispherical adjusting structure of claim 1, wherein the light source module includes a circuit board mounted between the inner movable member and the outer movable member, a light emitting member mounted on the circuit board, and a lampshade mounted on the circuit board and located outside of the light emitting member.

7. The hemispherical adjusting structure of claim 6, wherein the mounting stud of the outer movable member has an interior provided with a fitting hole for receiving the light source module, the fitting hole has a bottom provided with a stepped limit portion, and the lampshade of the light source module has a bottom provided with a restriction portion locked onto the stepped limit portion of the mounting stud.

* * * * *